US007617618B2

(12) United States Patent
Ahlbäumer

(10) Patent No.: US 7,617,618 B2
(45) Date of Patent: Nov. 17, 2009

(54) INSOLE AND SHOE HAVING AN INSOLE

(75) Inventor: Georg Ahlbäumer, St. Moritz (CH)

(73) Assignee: Cetec AG (DE)

( * ) Notice: Subject to any disclaimer, the term of this patent is extended or adjusted under 35 U.S.C. 154(b) by 664 days.

(21) Appl. No.: 10/527,645

(22) PCT Filed: Sep. 10, 2003

(86) PCT No.: PCT/EP03/10069

§ 371 (c)(1),
(2), (4) Date: Feb. 6, 2006

(87) PCT Pub. No.: WO2004/023916

PCT Pub. Date: Mar. 25, 2004

(65) Prior Publication Data

US 2006/0137216 A1 Jun. 29, 2006

(30) Foreign Application Priority Data

Sep. 10, 2002 (DE) ..... 102 41 961

(51) Int. Cl.
*A43B 7/06* (2006.01)

(52) U.S. Cl. ..... 36/3 B; 36/3 R; 36/147

(58) Field of Classification Search ..... 36/3 R, 36/3 B, 30 R, 147, 145, 166
See application file for complete search history.

(56) References Cited

U.S. PATENT DOCUMENTS

| | | | | | |
|---|---|---|---|---|---|
| 1,236,924 | A | * | 8/1917 | Golden | 36/147 |
| 1,264,122 | A | * | 4/1918 | Paul | 36/3 R |
| 1,959,050 | A | * | 5/1934 | Closson | 36/141 |
| 2,027,757 | A | * | 1/1936 | Whitfield et al. | 36/147 |
| 2,089,910 | A | * | 8/1937 | Reineke | 36/147 |
| 2,247,114 | A | * | 6/1941 | Boos | 36/147 |
| 2,307,416 | A | | 1/1943 | Margolin | |
| 2,408,792 | A | * | 10/1946 | Margolin | 36/147 |
| 2,765,545 | A | * | 10/1956 | Conrad, Sr. | 36/147 |
| 4,888,887 | A | * | 12/1989 | Solow | 36/3 R |
| 5,086,572 | A | * | 2/1992 | Lee | 36/3 R |
| 5,299,368 | A | * | 4/1994 | Liu | 36/3 B |
| 5,404,659 | A | | 4/1995 | Burke et al. | |
| 5,809,665 | A | * | 9/1998 | Suenaga | 36/43 |
| 5,996,250 | A | | 12/1999 | Reed et al. | |

(Continued)

FOREIGN PATENT DOCUMENTS

| | | |
|---|---|---|
| DE | 1 034 067 | 12/1958 |

(Continued)

*Primary Examiner*—Marie Patterson
(74) *Attorney, Agent, or Firm*—Black Lowe & Graham PLLC

(57) ABSTRACT

This invention relates to an insole which is essentially adapted to the profile of a human foot and has, in the middle foot area, an elastically deformable dome-like arch that faces the foot. To reduce the technical and financial production expense of an insole and to improve the wearing comfort of a shoe through an insole, in particular an insertable insole and to improve the fitting shape of the shoe by means of an insole and to feed air into and out of the shoe interior with the aid of an insole, the insole according to the invention exhibits in the region of the elastically deformable arch at least one ventilation opening, which during walking causes ventilation of the shoe interior in conjunction with the elastically deformable arch.

20 Claims, 5 Drawing Sheets

U.S. PATENT DOCUMENTS

| | | | | |
|---|---|---|---|---|
| 6,301,807 | B1 | 10/2001 | Gardiner | |
| 6,553,690 | B2 * | 4/2003 | Di Girolamo | 36/3 R |
| 6,655,048 | B2 * | 12/2003 | Moretti | 36/3 R |
| 7,146,750 | B2 * | 12/2006 | Issler | 36/3 B |
| 2002/0078590 | A1 * | 6/2002 | Collins et al. | 36/3 R |
| 2002/0095819 | A1 * | 7/2002 | Girolamo | 36/3 R |

FOREIGN PATENT DOCUMENTS

| | | | |
|---|---|---|---|
| DE | 7417875 | | 9/1974 |
| DE | 100 36 100 | C1 | 2/2002 |
| EP | 0 903 984 | B1 | 9/2000 |
| GB | 2 165 439 | A | 4/1986 |
| JP | 06-339402 | A | 12/1994 |
| JP | 11-032809 | | 2/1999 |
| JP | 2000-106908 | | 4/2000 |

* cited by examiner

INSOLE AND SHOE HAVING AN INSOLE

CROSS REFERENCE TO RELATED APPLICATION

This United States Utility Patent Application represents the national phase of International Application PCT/EP2003/010069 titled "INSOLE AND SHOE WITH INSOLE" filed on Sep. 10, 2003 and claiming priority from prior filed, German National Application Serial No. 102 41 961.2 filed on Sep. 10, 2002.

TECHNICAL FIELD

This invention relates to an insole which is essentially adapted to the profile of a human foot and has, in the middle foot area, an elastically deformable dome-like arch that faces the foot. Furthermore, this invention relates to a shoe with an insole.

BACKGROUND OF THE INVENTION

Insoles, in particular insertable insoles, for shoes have numerous functions. They improve the wearing comfort of shoes, e.g. by padding out the places facing the sole of the foot and the provision of damping elements. They are also used in the medical sector to correct faults in the gait of a person or to relax or stabilise the foot.

There are also insoles, which ventilate the inside of the shoe to counter unpleasant odours developing in the inside of the shoe. In particular with sports persons and people with heavy sweat formation, human vapours in the inside of the shoe lead to a possible strong odour which can be largely compensated with appropriate ventilation of the inside of the shoe.

Due to the described general problems, numerous patent documents deal with the formation of special shoe insoles which increase the wearing comfort of shoes or serve medical purposes.

For example, in the patent specification U.S. Pat. No. 5,404,659 and U.S. Pat. No. 6,301,807 insoles are described which, due to a filled out arch or an arch provided with supporting elements, cause a proprioceptive effect on the wearer of a shoe with such an insole, thereby reinforcing a foot in its structure, whereby, for example, the risk of injury is reduced.

Numerous patent specifications and applications deal with the ventilation of the inside of the shoe. For example, the applications JP-11032809A and JP-2000106908A show the inner ventilation of shoes, whereby the ventilation in both cases is provided by a pump integrated into the insole. In the application document JP-2000106908A the ventilation system also exhibits a duct, connected to the pump, and having ventilation ports, through which the air in the pump is pumped into the interior space of the shoe when the pump is pressed. Furthermore, there are also cypress chips in the pump which are intended to aromatise the ventilating air.

EP-0 903 984-B1 shows a version of a shoe internal ventilation system, consisting of a shoe outer sole, an insole and a corresponding middle sole. In this respect the invention exhibits air chambers between the middle sole and the shoe outer sole in the front section of the foot, the air from the chambers being led into the inside of the shoe through holes in the insole in the front foot section during movement due to the deformation in these sections.

Since with a shoe insole a mass-produced article is involved, it is especially important to keep the technical effort and the financial manufacturing costs of such an article as low as possible.

BRIEF SUMMARY OF THE INVENTION

To achieve these objectives, it is the object of this invention to reduce the costs and material expenses for the manufacture of insoles with respect to the state of the art and to reduce the manufacturing costs of a shoe comprising these insoles. Furthermore, the object is to improve the wearing comfort of a shoe due to an insole, in particular due to an insertable insole and to increase the fitting shape of the shoe by means of an insole and to aerate and extract the air inside the shoe with the aid of an insole.

These objects are solved in an inventive way by the object of Claim 1. Advantageous embodiments of the invention are the object of a number of subclaims.

This invention is based on the knowledge that due to the formation of an elastically deformable dome-like arch that faces the foot the wearing comfort of a shoe can be substantially improved with the insole according to the invention. Due to the formation of an arch on the upper side of the insole, the insole lies in contact with the sole of the foot throughout the complete movement sequence during walking. This increases subjectively the wearing comfort for the wearer of a shoe with the insole according to the invention. If the arch of the insole is in the middle section of the foot, then the forces acting during the movement can be used especially advantageously for the deformation of the arch and consequently for the air circulation (ventilation) in the shoe.

In particular it is of advantage if the insole is an insertable insole, because it can be replaced as required when damaged or with heavier wear.

The insole according to the invention exhibits air venting holes through which air is passed into and led out of the inner region of the inside of the shoe. Due to the deformation of the pronounced, unfilled arch of the insole in the middle foot section caused by walking, air is pumped through the air venting ports in the inside of the shoe.

A large number of holes in the insole, preferably thirty, has proven to be advantageous, because an especially good ventilation of the shoe interior can be obtained through a large number of holes.

It is particularly practicable to pass the air simultaneously via ventilation grooves running on the bottom of the insole to facilitate an exchange of air in the shoe interior.

For an efficient exchange of air it is also advantageous if the grooves on the underside of the insole run radially from the arch to the outer edges of the insole.

As the arch returns to shape after its deformation, the air is drawn in through the ventilation holes from the shoe interior into the air chamber formed in the region between the arch and the shoe insole and simultaneously fresh air is passed through the ventilation grooves from outside into the air chamber. Consequently, a continuous exchange of air in the shoe interior is facilitated.

As described, the wearing comfort can be increased due to the formation of an arch on the insole and at the same time simple ventilation of the shoe interior can be achieved without large material and financial expenses.

To improve the damping properties of the insertable sole, sections can be formed in the regions of the heel and ball of the foot on the shoe sole from a rubber mixture.

Due to the properties advantageous for an insole, such as flexibility, stress capability, etc., it is practicable to form the insole in an elastic plastic material or from another material which has the stated properties.

By the means of webs, which are formed on the underside of the insole in the region of the arch, the arch can be additionally stabilised without the ventilation effect reducing. Depending on the desired stiffness, the insole can be provided with at least one web.

The wearing comfort can be increased still further by a textile on the upper side of the insole facing the foot.

The insole according to the invention can be used especially effectively in an appropriately adapted shoe. In this respect it is practicable if the shoe facilitates in a supporting way the circulation of the air in the shoe interior, i.e. the feed and extraction of air via the ventilation grooves in the insole.

Air channels, to which the grooves in the insole correspond, can be provided on a side outer wall of the shoe for an especially efficient ventilation of the shoe interior. The air ventilated via the grooves can be passed via the air channels along the side outer wall of the shoe to the outside.

The use of a gas-permeable membrane, at least at the points of the ventilation grooves ending at the shoe, which enables an exchange of air in the shoe interior via the ventilation grooves, has proved to be particularly advantageous in this connection.

The membrane is intended to prevent the penetration of fluids and dirt into the shoe interior and to permit the flow of the fluid from the shoe interior to the outside. For example, materials similar to GORE-TEX can be considered for the membrane. The membrane is advantageously integrated into the outer material of the shoe.

BRIEF DESCRIPTION OF THE DRAWINGS

The invention is explained in more detail based on the preferred embodiments illustrated in the enclosed drawings. Similar or corresponding details are given the same reference symbols in the figures. The following are shown.

DETAILED DESCRIPTION OF THE INVENTION

Figures 1, 2:
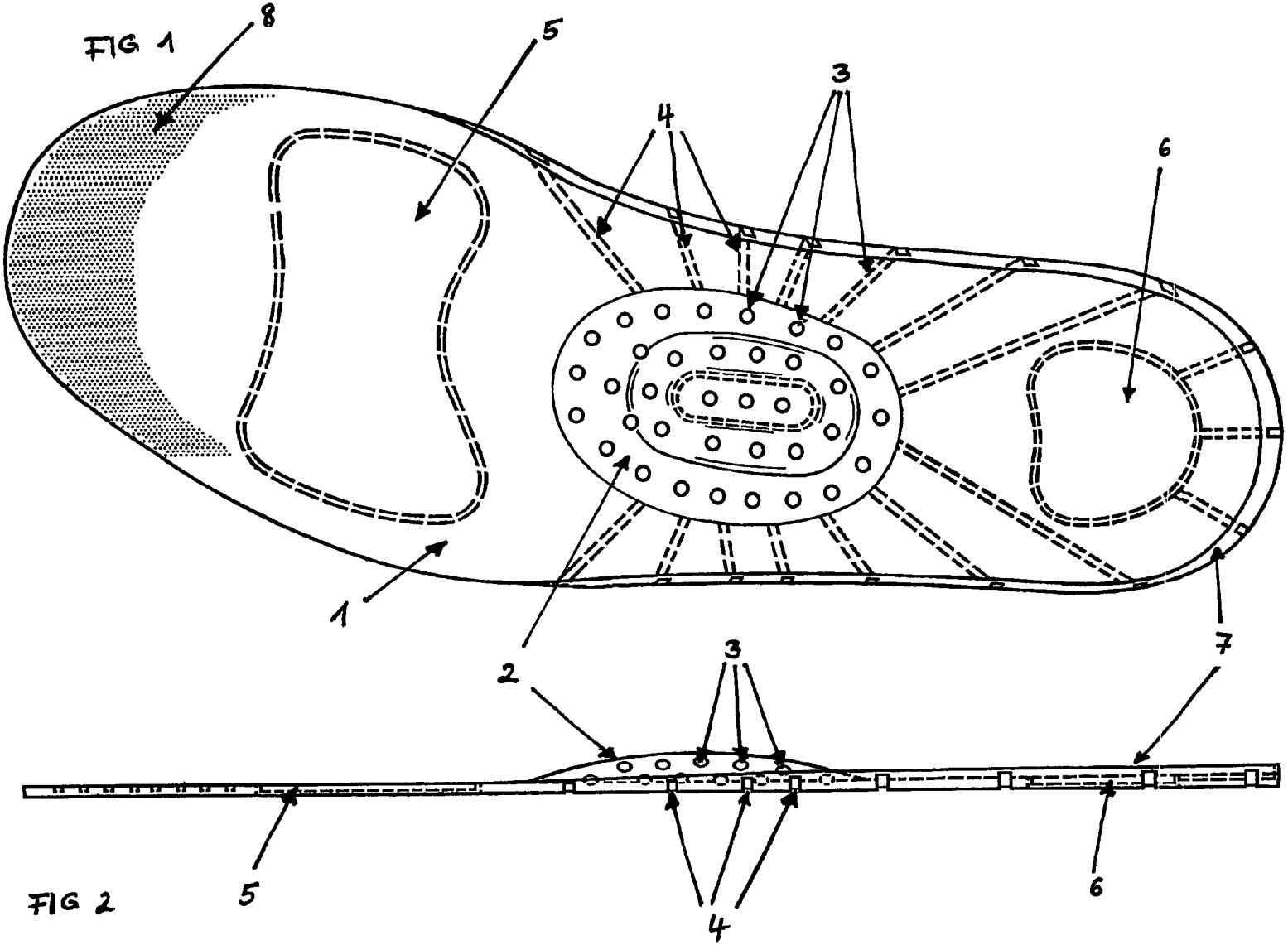
FIG. 1 the upper side of an insole according to the invention facing the foot, FIG. 2 a side view of the insole in FIG. 1, FIG. 3 a view on the underside of the insole in FIG. 1 facing the shoe sole, FIG. 4 a section along the sectioning line A-A in FIG. 3, FIG. 5 a shoe with an insole according to the invention from FIG. 1, FIG. 6 a detail enlargement of the region labelled with D in FIG. 5, FIG. 7 a further detail enlargement of the region labelled with D in FIG. 5, FIG. 8 and FIG. 9 two example embodiments of the arch of the insole in FIG. 1 in a front view, and FIG. 10A and FIG. 10B an example embodiment of the arch of the insole in a front view and a side view, whereby the arch is stabilised with a number of webs.

FIG. 1 shows as an example a view on the upper side of an insole 1 according to the invention which is facing the foot. The shape of the shoe sole is here adapted essentially to the profile of a human foot. The insole 1 has in its centre an arch 2, which will be described again more clearly with reference to FIG. 2. Contour lines indicate the raising of the arch 2.

The arch 2 has a number of ventilation openings 3, which are arranged in the illustrated embodiment laterally to the arch surface 2. Due to the ventilation holes 3, the air can be pumped out of the air chamber, formed by the arch 2 and the shoe insole, into the shoe interior and air can pass out of the shoe interior into the arch. The ventilation openings 3 are formed in the illustrated embodiment by the holes punched in the insole 1.

A number of radially running ventilation grooves 4 are formed on the arch 2. The ventilation grooves run along the underside of the insole 1 on the outer edge of the insole 1, which will be explained in more detail with reference to FIG. 2.

In the region of the heel and also the ball of the foot there are two regions 5, 6 formed by a rubber mixture, which increase the dampening properties of the insole 1 in the appropriate areas. Furthermore, an edge prominence 7 is provided on the outside of the insole 1 which essentially extends between the ball of the foot to the heel region. The edge prominence simplifies the insertion of the insole 1 into a shoe if it is formed as an insertable sole and increases the wearing comfort.

In addition, on the upper side of the insole 1 a thin layer formed by a textile is fitted which is indicated by the surface structure 8.

FIG. 2 illustrates a side view of the insole 1 in FIG. 1. In the regions of the ball of the foot and the heel the dampers 5, 6 can be seen. Furthermore, the ventilation grooves 4 are illustrated which lead radially from the arch 2 to the edge of the insole. In the centre of the sole there is the arch 2 which is provided with numerous ventilation holes 3. Furthermore the edge prominence 7 of the insole 1 is illustrated.

Figure 3:
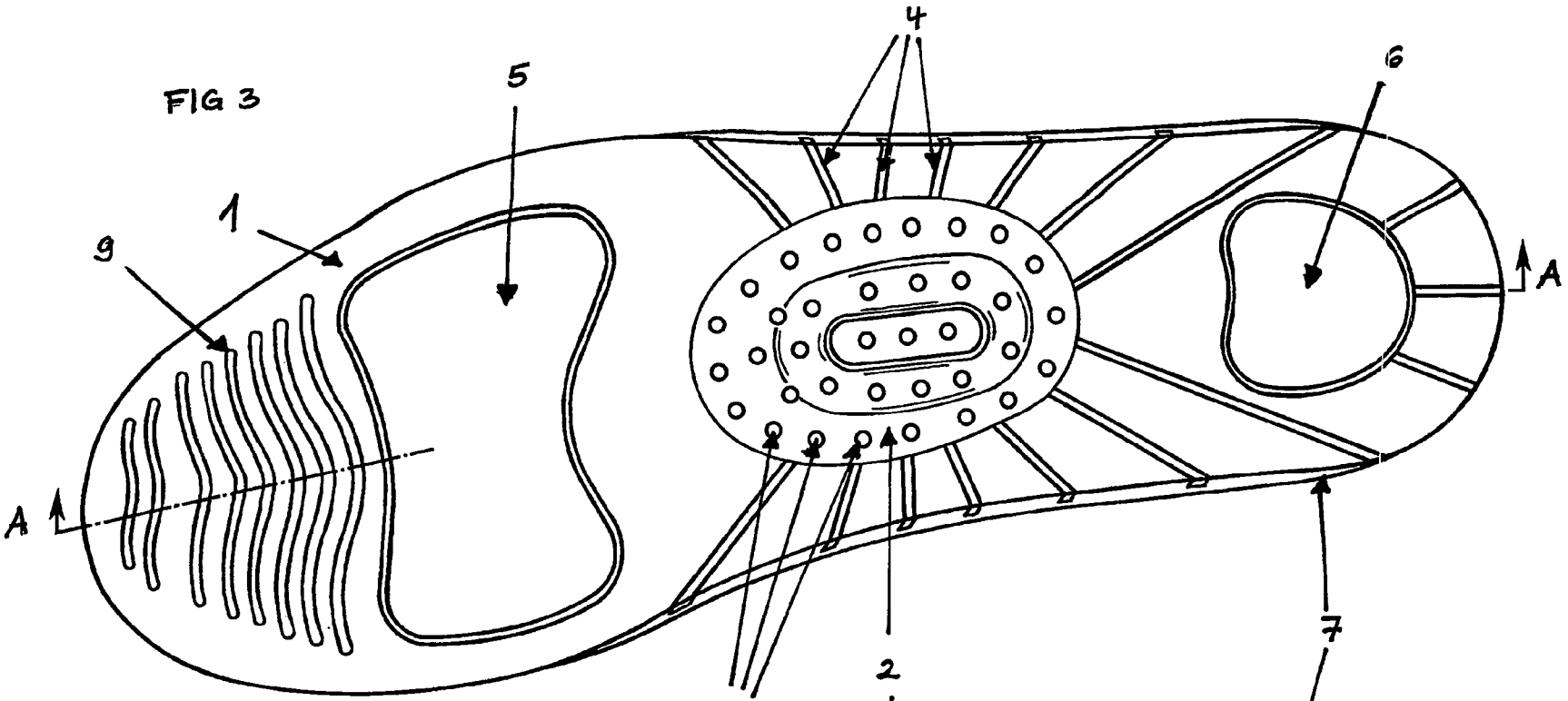

FIG. 3 illustrates the underside of an insole from FIG. 1 facing the shoe sole. FIG. 3 shows essentially the same elements as illustrated in FIG. 1.

In the central foot region of the insole 1 there is the arch 2 which is provided with a number of ventilation holes 3. In the arch 2 a number of contour lines are indicated which indicate the orientation of the arch.

A number of ventilation grooves 4 are located running from the arch 2 outwards. The number of ventilation grooves can be varied and must be selected appropriately.

In the region of the ball of the foot the damper 5 is formed and a further damper 6 is formed in the heel region. The dampers 5, 6 can be formed both on the upper side of the insole 1 and also on its underside. In the region of the toes a structure 9 is indicated, which, for example, can serve to prevent the insole 1 sliding in the shoe. The edge prominence 7 can also be seen.

The arch 2 facing the foot forms an air chamber on the underside, facing the shoe. As will be later explained with reference to FIG. 5, the air from the shoe interior can be exchanged with air from outside the shoe via the ventilation holes 3 and the grooves 4. This provides ventilation of the shoe interior.

In this respect it is practicable if the grooves 4 are not so deformable due to the stress from the human foot during walking that no exchange of air can take place. A certain stiffness of the grooves 4 is therefore to be provided. Similarly, it must be ensured in this connection that the wearing comfort of a shoe 12 with the insole 1 is not reduced due to any stiffening of the grooves 4.

Figure 4:
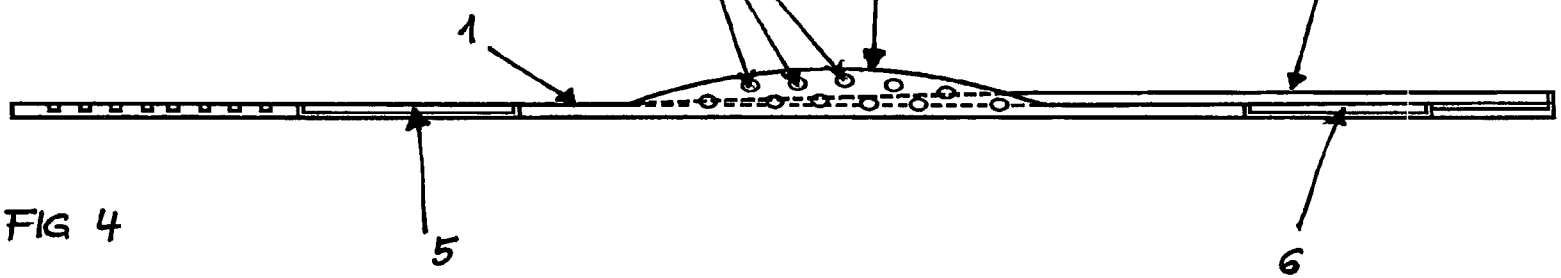

FIG. 4 shows a section of the insole 1 along the sectioning line A-A in FIG. 3. On the underside of the insole 1 facing the shoe the dampers 5, 6 can be seen. On the upper side facing the foot the arch 2 with ventilation holes 3 can be seen in the centre of the sole. The edge prominence 7 is formed at the regions of the ball of the foot and the heel.

In the following the advantages of the shoe sole according to the invention in FIGS. 1 to 4 and its ventilation function are explained in more detail with reference to FIG. 5.

Figure 5:
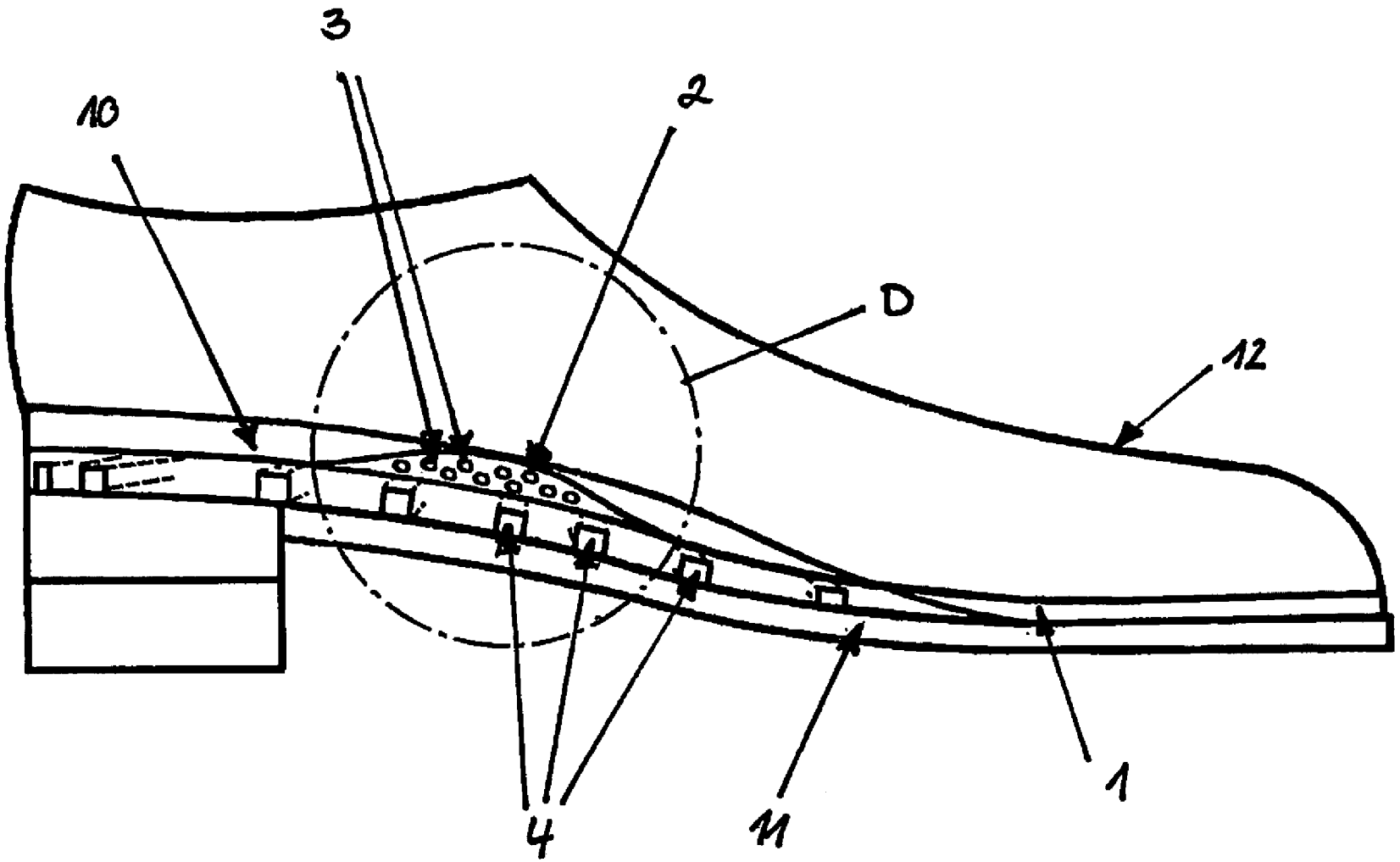

FIG. 5 shows a shoe with an insole according to the invention and according to FIGS. 1 to 4. The insole 1 is here inserted into the shoe 12. A region formed by a membrane 10 is formed on the shoe or is integrated into the shoe material and the air from the shoe interior can be exchanged with the outside air through this region.

Due to movement the arch 2 in the shoe interior alternately deforms and returns to shape due to the pressure from the foot.

During the deformation of the arch 2, the air located in the air chamber formed by the arch 2 is pumped through the ventilation grooves 4 to the outside of the insole 1. The air passed from the inner region of the shoe can be discharged to the outside through the membrane 10.

Also caused by the deformation, a part of the air located in the air chamber simultaneously enters the shoe interior through the ventilation holes 3.

On returning to its original shape the air chamber formed by the arch again fills with air. Here, fresh air passes via the grooves 4 through the membrane 10 from the outer region of the shoe 12 into the air chamber and air located in the shoe interior is fed through the ventilation holes 3 to the air chamber.

During the next deformation of the arch 2, the air mixture present in the air chamber is, as described, partly pumped back into the shoe interior or discharged to the outer region of the shoe. In this way ventilation of the shoe internal region can be achieved and at the same time fresh air from the outer region of the shoe is passed via the membrane 10 and the grooves 4 to the shoe interior. Consequently, a continuous exchange of air in the inner region of the shoe is ensured.

From the description of the ventilation effect it will be appreciated that the grooves must be formed such that they do not deform due to the pressure loading from the human foot such that the air transport is suppressed by the grooves 4. Therefore, the plastic material must be selected, at least in the region of the grooves, such that the air circulation between the inner region of the shoe and the outer region of the shoe is ensured.

The membrane 10, which is fitted in the region of the grooves 4, must be selected appropriately such that it facilitates circulation of the air between the inner region and the outer region of the shoe.

Figure 6:
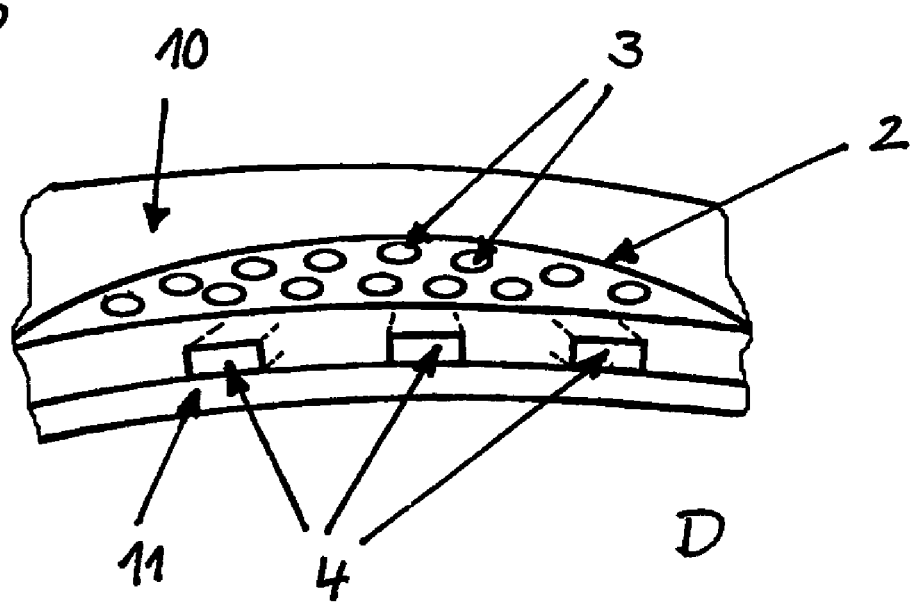

FIG. 6 shows a detail view from FIG. 5, which is labelled with D in this figure. In detail it can be seen how the insole 1 lies on the shoe sole 11, whereby due to the grooves 4 ventilation and aeration ducts are formed between the air chamber formed under the arch 2 and the membrane 10. The ventilation holes 3 are also illustrated.

Figure 7:
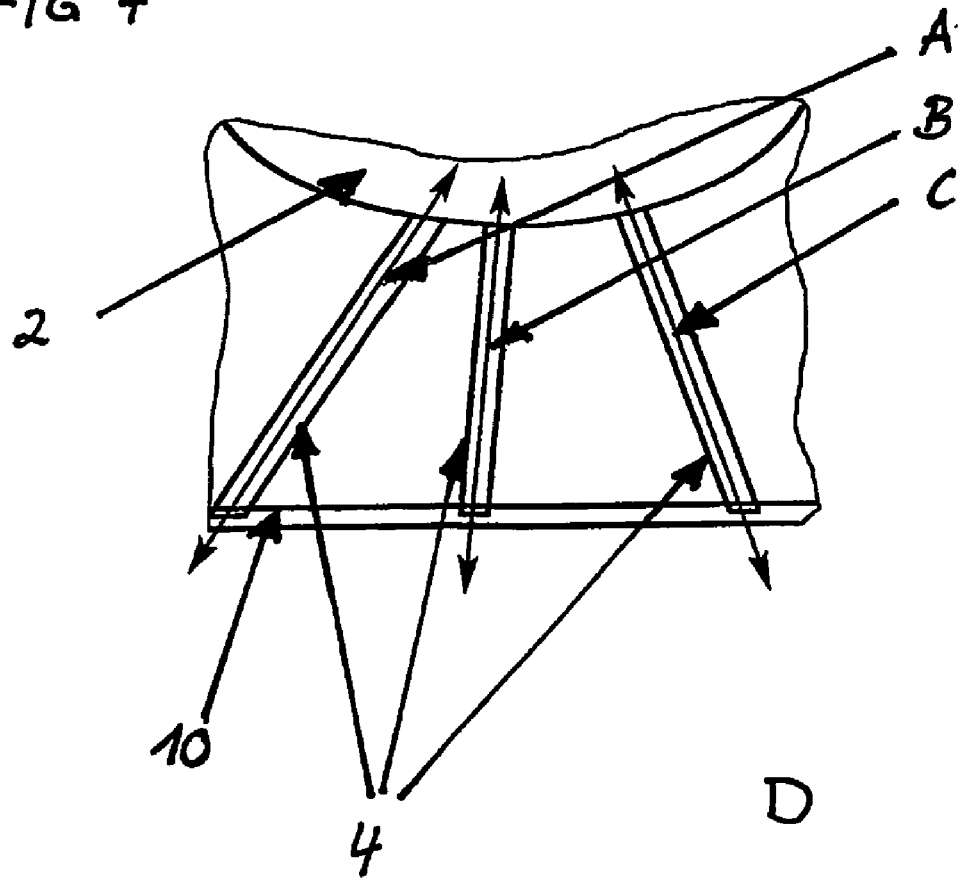

FIG. 7 shows a detail view of the region labelled D in FIG. 5 in a plan view on the upper side of the insole 1. In the figure the arched area 2, the membrane 10 and a number of grooves 4 are indicated.

Here, it can be seen how the grooves 4 form the ventilation and aeration ducts between the air chamber under the arch 2 and the outside of the insole 1 in contact with the membrane 10.

The arrows A, B and C here indicate examples of the air flow which arises due to the deformation and return to shape of the arch 2 and therefore of the air chamber. The elastic deformation of the arch 2 leads to the ventilation effect previously described and to the exchange of air from the shoe interior with the outer region of the shoe.

When selecting the membrane 10, it must be ensured that it is where possible permeable to gases and at the same time suppresses the penetration of moisture or dirt into the shoe interior. At the same time though, the membrane should facilitate the discharge of moisture from the shoe interior to the outside of the shoe. For example, GORE-TEX materials or similar materials can therefore be used advantageously.

Depending on the embodiment, the membrane 10 can be formed only in the region surrounded by grooves 4 or for example it may be a constituent part of the complete outer material of the shoe or itself may only represent a constituent part of the shoe material. In the latter case it is also practicable if the shoe material, into which the membrane 10 is integrated, is permeable to gas and moisture.

Also, it is possible that only openings in the shoe outer material are provided at the ends of the ventilation grooves 4 and the ventilated air can be passed through them, without flowing through a membrane 10, to the outside of the shoe. Of course, these holes can also be closed off with a membrane 10.

The formation of the region of the shoe outer material adjacent to the ventilation grooves must be selected according to the properties (e.g. with regard to wear resistance, air permeability, fluid permeability, etc.) of the material and the condition of any membrane 10 which is used.

Particularly in the latter connection, air ducts, which correspond to the grooves 4 of the insole 1, can also be provided in the side outer wall of the shoe 12. Through the air ducts, the ventilated air of the grooves 4 engaging them can then be transported to the outside of the shoe. In this way the exit height of the ventilated air, i.e. the distance from the ground to the discharge openings for the ventilated air on the shoe 12, can be varied.

Figure 8:
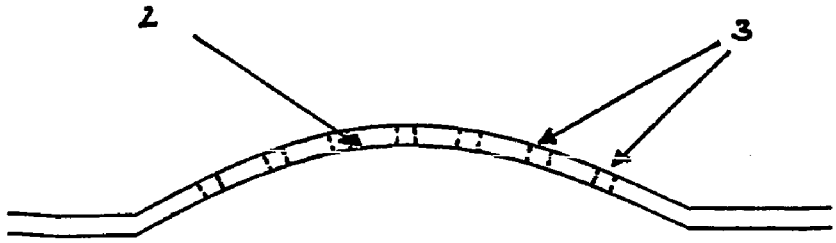
Figure 9:
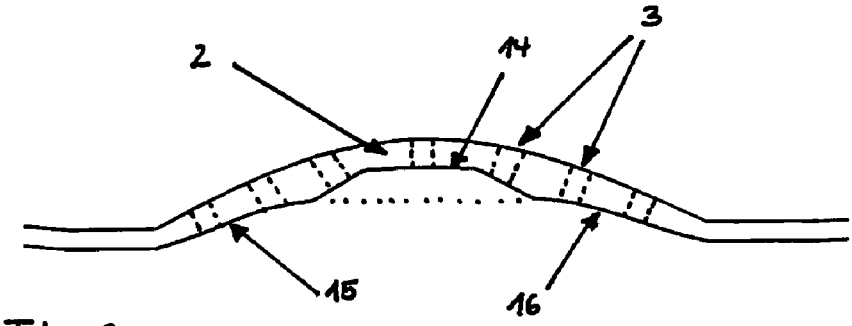

FIGS. 8 and 9 illustrate two example embodiments of the arch 2 of the insole 1 from FIG. 1 in a front view. Ventilation holes 3 are provided on both of the arches 2 illustrated. As shown in FIG. 8, the arch 2 does not exhibit any internal structure. The lower wall of the arch 2 runs essentially parallel to that of the upper side. In this respect the underside of the arch 2, as well as the arch itself, is essentially of convex form.

As shown in FIG. 9, the walls of the arch 2 can exhibit a structure on the underside of the insole 1. In the embodiment the dotted line indicates how the side walls 15, 16 run together to form a convex shape and in the central section of the arch 2 are interrupted or hollowed out by an indentation 14. The indentation 14 is flanked by two bevelled walls, which run into a surface formed approximately parallel to the upper side of the arch 2.

Depending on the structure used, the mechanical properties of the arch 2 can be varied, i.e. in terms of the stiffness and wearing comfort. The ventilation mechanism of the arch is not reduced by this. Also, with variations in the selection of the structure of the arch 2 on its inner side production-specific requirements play an important role.

Figure 10A:
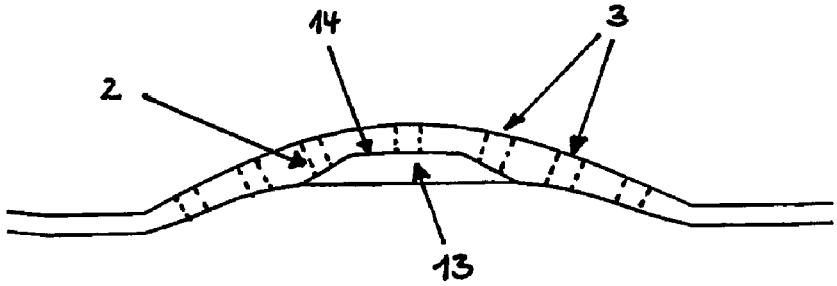
Figure 10B:
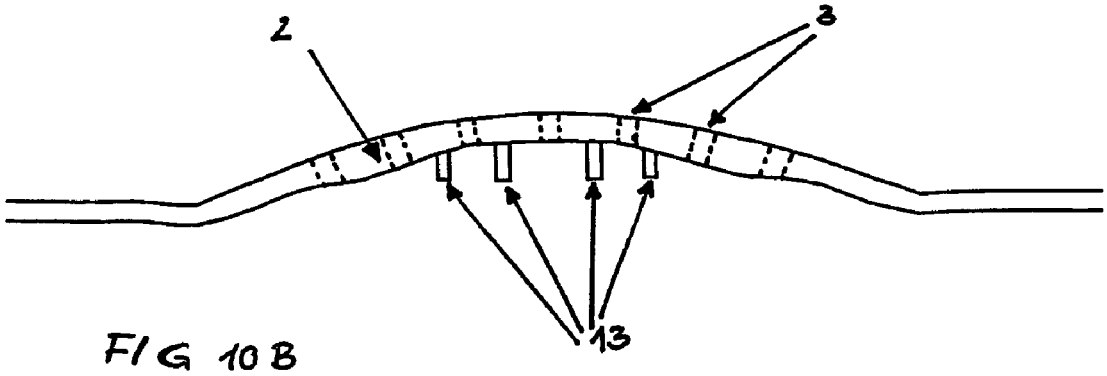

FIGS. 10A and 10B show an example embodiment of the arch 2 of the insole 1 in a front view and side view, whereby the arch 2 is stabilised with a number of webs 13. FIG. 10A here shows the front view on the embodiment. The structure of the arch 2 of the insole 1 on the underside is similar to that shown in FIG. 9. In addition in an indentation 14 on the underside of the insole 1, the arch 2 exhibits a number of webs 13 which run laterally to the longitudinal direction of the insole 1. The webs 13 are in their number and embodiment, i.e. for example in their thickness, height, stiffness, the way of running (e.g. laterally or longitudinally to the longitudinal axis of the insole 1), selected such that they conform to the individual requirements of wearing comfort, stiffness and/or production-specific requirements.

FIG. 10B illustrates a side view of the arch 2 shown in FIG. 10A; as an example, a possible arrangement of the webs 13 in the arch is shown in the figure.

In the selection of the form of the structure of the underside of the arch 2, it is, independent of the individual formation of the walls of the arch 2, possible to provide the webs 13 illustrated in FIGS. 10A and 10B.

For example, simple bevelling of the outer edge of the arch 2 towards the inside is possible, which ends in a surface terminating approximately parallel to the shoe sole. This structure can in turn be stabilised by means of webs 13 and adapted to the individual requirements.

The invention claimed is:

1. An insole (1) for footwear having an underside and a foot facing side, the insole being adapted to the profile of a human foot, comprising:

in a central foot section an elastically deformable dome-shaped arch (2) facing the human foot, wherein the arch (2) exhibits at least one ventilation opening (3), which during walking and in conjunction with the elastic form of the arch (2) provides ventilation of the shoe interior characterized in that the arch at the underside of the insole (1) exhibits a structure which in profile view has side walls (15,16) which run together to form a convex shape and are interrupted by an indentation (14) in the central section of the arch (2) and in that the so formed structure adapts mechanical characteristics of the insole pertaining to stiffness and comfort.

2. Insole according to claim 1, characterized in that the insole (1) is adapted to be insertable into an item of human footwear.

3. Insole according to claim 1, characterized in that the ventilation opening (3) is formed by at least one hole, which is punched in the region of the elastically deformable arch (2) in the insole (1).

4. Insole according claim 1, characterized in that the insole (1) exhibits at least twenty ventilation holes.

5. Insole according to claim 1, characterized in that the insole (1) exhibits grooves (4) on its underside, via which ventilated air from the shoe interior is exchanged for outside air.

6. Insole according to claim 5, characterized in that the ventilation grooves (4) run essentially radially from the arch (2) to the outer edge of the insole (1).

7. Insole according to claim 1, characterized in that the insole (1) exhibits a region (5, 6) in its areas at a heel and ball of the foot which is formed from a rubber mixture that possesses damping properties.

8. Insole according to claim 1, characterized in that at least one web (13) is provided on the arch (2).

9. Insole according to claim 1, characterized in that the insole consists of an elastic plastic material.

10. Insole according claim 1, characterized in that the insole has a surface (8) formed by a textile on its side facing the foot.

11. An insole (1) according claim 1 including a human shoe with the insole inserted in the shoe.

12. Shoe and insole according to claim 11, characterized in that the insole (1) exhibits grooves (4) via which ventilated air from the shoe interior is exchanged for outside air, wherein the grooves of the insole (1) correspond with air ducts through which the air ventilated via the grooves (4) is passed along a side outer wall of the shoe (12) to the outside.

13. Shoe and insole according to claim 11, characterized in that the air passed through the grooves (4) due to the deformation of the elastically deformable arch (2) is passed through a gas-permeable membrane (10) to the outside.

14. Shoe and insole according to claim 13, characterized in that the membrane (10) is at least fitted to points of the ventilation grooves on the shoe (12) ending at the shoe.

15. Shoe and insole according to claim 11, characterized in that air from an area outside of the shoe is passed into the shoe interior through a gas-permeable membrane (10) via the ventilation grooves (4) during the return to original shape of the elastically deformable arch (2).

16. An insole (1) for footwear having an underside and a foot facing side, the insole being adapted to the profile of a human foot, comprising:

in a central foot section an elastically deformable dome-shaped arch (2) facing the human foot, characterized in that the arch at the underside of the insole (1) exhibits a structure in which in profile view has side walls (15,16) which run together to form a convex shape and are interrupted by an indentation (14) in the central section of the arch (2) and in that the so formed structure adapts mechanical characteristics of the insole pertaining to stiffness and comfort.

17. Insole according to claim 16, characterized in that the insole (1) exhibits a region (5, 6) in its areas at a heel and ball of the foot which is formed from a rubber mixture that possesses damping properties.

18. Insole according to claim 16, characterized in that at least one web (13) is provided on the arch (2).

19. Insole according to claim 16, characterized in that the insole consists of an elastic plastic material.

20. Insole according claim 16, characterized in that the insole has a surface (8) formed by a textile on its side facing the foot.

* * * * *

UNITED STATES PATENT AND TRADEMARK OFFICE

CERTIFICATE OF CORRECTION

PATENT NO. : 7,617,618 B2
APPLICATION NO. : 10/527645
DATED : November 17, 2009
INVENTOR(S) : Georg Ahlbäumer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 956 days.

Signed and Sealed this

Fourteenth Day of December, 2010

David J. Kappos

David J. Kappos
*Director of the United States Patent and Trademark Office*